US010175013B1

(12) United States Patent
Shoffner et al.

(10) Patent No.: US 10,175,013 B1
(45) Date of Patent: Jan. 8, 2019

(54) MODIFIED RIFLE LOWER RECEIVER, RELATED COMPONENTS, CARTRIDGES, AND METHODS

(71) Applicants: Mitchel W. Shoffner, Wilmington, NC (US); David L. Grange, Wilmington, NC (US); William B. Haner, Sanford, FL (US)

(72) Inventors: Mitchel W. Shoffner, Wilmington, NC (US); David L. Grange, Wilmington, NC (US); William B. Haner, Sanford, FL (US)

(73) Assignee: Osprey Combat, LLC, Council, NC (US)

( * ) Notice: Subject to any disclaimer, the term of this patent is extended or adjusted under 35 U.S.C. 154(b) by 0 days.

(21) Appl. No.: 15/434,846

(22) Filed: Feb. 16, 2017

Related U.S. Application Data

(60) Provisional application No. 62/295,838, filed on Feb. 16, 2016.

(51) Int. Cl.
*F41A 3/66* (2006.01)
*F41A 9/59* (2006.01)
*F41A 3/72* (2006.01)

(52) U.S. Cl.
CPC ..... *F41A 3/66* (2013.01); *F41A 3/72* (2013.01); *F41A 9/59* (2013.01)

(58) Field of Classification Search
CPC ..... F41A 3/72; F41A 3/66; F41A 9/59
USPC ..... 42/18, 16.1, 6; 89/33.1, 198, 191.01
See application file for complete search history.

(56) References Cited

U.S. PATENT DOCUMENTS 5,351,598 A * 10/1994 Schuetz ..... F41A 5/18 42/25
6,070,352 A * 6/2000 Daigle ..... F41A 11/02 42/49.02
9,797,666 B2 * 10/2017 Schuetz ..... F41A 11/02
9,835,395 B2 * 12/2017 Ruby ..... F41C 27/00
(Continued)

OTHER PUBLICATIONS

NPL: https://www.americanrifleman.org/articles/2016/6/16/tested-cmmg-nnkw-anvil-xbe-rifle/ Jun. 16, 2016.*
(Continued)

*Primary Examiner* — John Cooper
(74) *Attorney, Agent, or Firm* — Allen Dyer Doppelt & Gilchrist

(57) ABSTRACT

A modified lower receiver for a standard assault rifle includes a modified receiver body and a magazine release. The modified receiver body defines a modified magazine well, a trigger well and modified forward and rear takedown holes, and the magazine release is mounted on a side of the modified receiver body and extends into the modified magazine well. The modified magazine well is longer than a magazine well of a standard lower receiver by a predetermined distance forward of the magazine release. Positions of the modified forward and rear takedown holes are also forward of respective standard positions of forward and rear takedown holes by the same predetermined distance. A method of modifying the assault rifle includes removing the standard lower receiver and firing pin from an upper receiver, installing a longer, modified firing pin into the upper receiver, and installing the modified lower receiver on the upper receiver.

12 Claims, 4 Drawing Sheets

(56) References Cited

U.S. PATENT DOCUMENTS

| | | | | |
|---|---|---|---|---|
| 2010/0229445 | A1* | 9/2010 | Patel | F41A 3/66<br>42/6 |
| 2014/0223791 | A1* | 8/2014 | Ruby | F41C 27/00<br>42/49.01 |
| 2015/0198394 | A1* | 7/2015 | Hochstrate | F41A 3/26<br>42/17 |
| 2015/0267978 | A1* | 9/2015 | Miller | F41A 5/18<br>89/198 |
| 2015/0267979 | A1* | 9/2015 | Miller | F41A 3/00<br>89/191.01 |
| 2018/0003457 | A1* | 1/2018 | McCallum | F41A 19/10 |

OTHER PUBLICATIONS

NPL: https://www.ar15.com/forums/ar-15/AR_Lower_Receiver_FAQ_56k_beware_MMS_CMT_LAR_LMT_compared_/12-318113/ Mar. 4, 2007.*

NPL: http://wintersoldier2008.typepad.com/summer_patriot_winter_sol/2014/04/a-boiler-room-comparison-of-the-new-dpms-gen-ii-ar-15-in-308-winchester-w-my-ar-15-in-jjs-brit-w-the.html Apr. 29, 2014.*

* cited by examiner

MODIFIED RIFLE LOWER RECEIVER, RELATED COMPONENTS, CARTRIDGES, AND METHODS

CROSS-REFERENCE TO RELATED APPLICATION

This application claims the benefit of U.S. Provisional Application Ser. No. 62/295,838, filed on Feb. 16, 2016, the contents of which are herein incorporated by reference in their entirety.

FIELD OF THE INVENTION

The present invention relates to rifles, and more particularly, to rifle modifications allowing the firing of differently dimensioned cartridges.

BACKGROUND OF THE INVENTION

The AR-15 platform is one of the most popular and widely used assault rifle platforms in the world; particularly in the armed forces of North Atlantic Treaty Organization (NATO) member countries. Technically, AR-15 is a trademark used by the ArmaLite company and later sold to Colt. Colt currently makes perhaps the most famous AR-15 variants, the M16 rifles and the newer M4 carbines. However, a large number of firearm manufacturers now produce firearms understood to be AR-15 variants (e.g., Rock River Arms, Ruger, Stag Arms, etc.). The widespread adoption of the AR-15 standard has lead to the availability of a large variety of interchangeable parts (e.g., barrels, upper receivers and stocks) and accessories, making the AR-15 platform very adaptable and further increasing its popularity. For the purposes of this application, while noting that there are other assault rifles standards (e.g., the AR-10 platform), the term "standard assault rifle" shall be defined to refer to AR-15 rifles and AR-15 variants.

The most standardized portion of a standard assault rifle is the lower receiver (which is also the part considered, under U.S. law, a firearm in its own right). Significant components of the lower receiver include the magazine well, the trigger well, an attachment point for a pistol grip and a collar for receiving a buffer tube of a stock. Two sets of holes are defined through the sides of the lower receiver, with the holes accepting takedown/pivot pins for connection to an upper receiver. The distance between these sets of holes is the same on all standard assault rifles, allows for the ready interchangeability of other components, and has generally delimited the overall size of the lower receiver. Despite the advantages offered by existing standard assault rifles, further improvements are possible.

SUMMARY OF THE INVENTION

In view of the foregoing, it is an object of the present invention to provide a modified lower receiver for a standard assault rifle, as well as related components, and methods of assembly and use. According to an aspect of the present invention, the modified lower receiver accommodates a longer cartridge than was hitherto possible in standard assault rifles. According to another aspect of the present invention, a lengthened firing pin is provided for use in connection with the modified lower receiver. According to a further aspect of the present invention, a cartridge is provided having dimensions suitable for use in connection with the modified lower receiver.

These and other objects, aspects and advantages of the present invention will be better appreciated in view of the drawings and following detailed description of preferred embodiments.

DETAILED DESCRIPTION OF PREFERRED EMBODIMENTS

Figure 1:
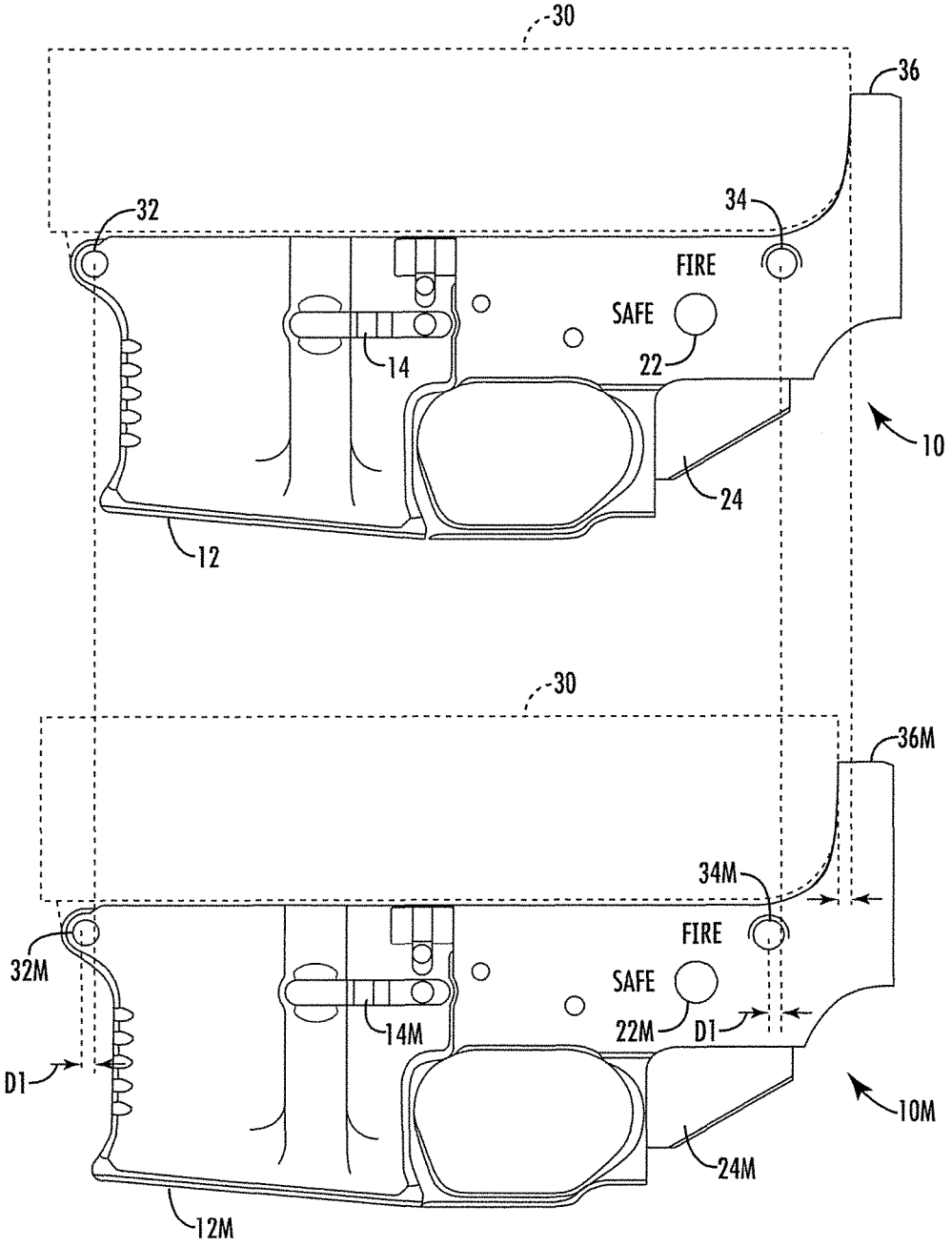
FIG. 1 is a side view of a modified rifle lower receiver compared to a standard receiver, according to an embodiment of the present invention.
Figure 2:
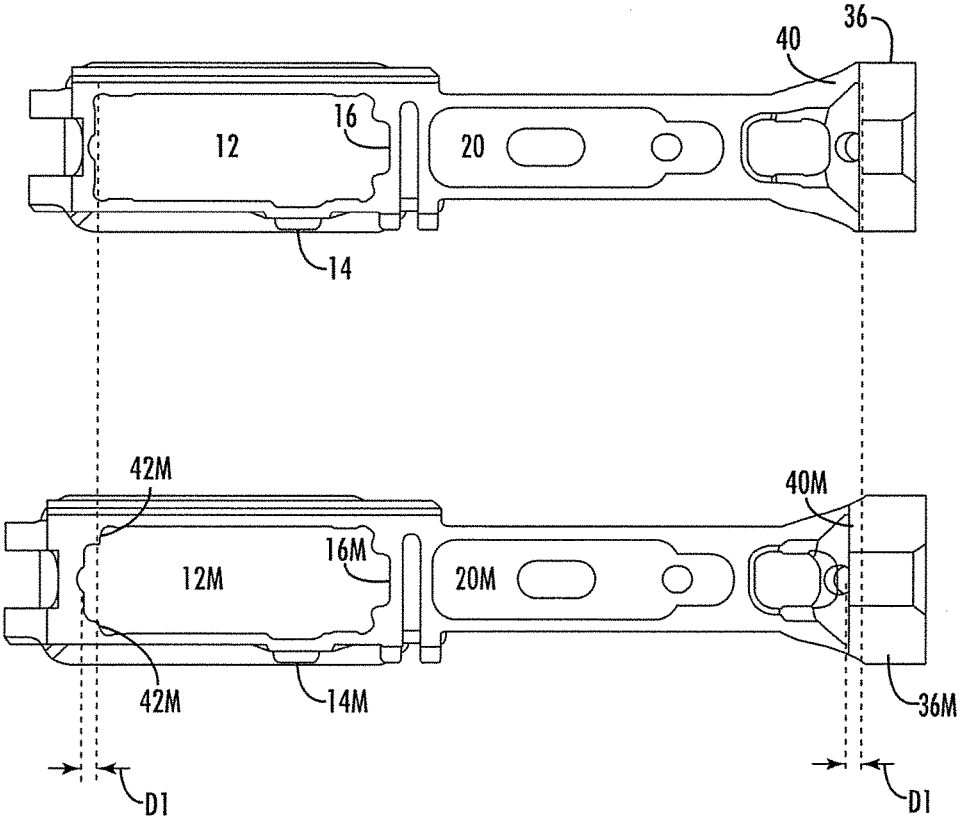
FIG. 2 is a top view of the modified rifle lower receiver of FIG. 1 compared to the standard receiver.

Referring to FIGS. 1 and 2, according to an embodiment of the present invention, a lower receiver 10M for a standard assault rifle is modified by increasing the length of the magazine well 12M by a predetermined distance D1 (most advantageously 0.3125 inch) relative to a standard lower receiver 10, the length being added forward of the magazine release 14M (i.e., the distance between the magazine release and the rear wall 16M of the magazine well 12M is unchanged. However, the rest of the lower receiver 10M will be left unmodified, except as described herein.

All directional terms, such as "(left/right) side," "top," "bottom," "forward" and "rear" are used with reference to an assault rifle held conventionally and pointed downrange with the firing axis parallel with the ground. For example, in such orientation, the sites are understood to be "above" the trigger, the muzzle is understood to be "forward" of the stock, and the ejection port is located on a "side" of the upper receiver. As used herein, the "length" direction extends forward-to-rearward, while the "width" direction extends side-to-side, and the "height" and/or "depth" directions extend top-to-bottom. For referential purposes, dimensions of a modified lower receiver will sometimes be given relative to dimensions of a standard lower receiver. Unless otherwise indicated, such a reference does not constitute a claim to any element of a standard lower receiver.

Since the magazine well 12M has been lengthened by D1, the positions of the magazine release 14M, the trigger well 20M, the fire/safe selector switch 22M and the pistol grip attachment point 24M will all be effectively rearward by the length D1 of their standard locations relative to a given point on an upper receiver 30 (indicated generically in broken lines). However, the present inventors have found that these changes will not adversely impact operation of the standard assault rifle, subject to the use of a modified firing pin, as described below.

The increase in length D1 would result in an increased distance between holes for takedown/pivot 32M, 34M (referred to herein simply as "takedown holes") of 0.3125 inch. To preserve compatibility with standard assault rifle upper receivers 30, the rear takedown hole 34M will also be moved forward by distance D1, thereby maintaining the standard distance from the forward takedown hole 32M, while changing—without detriment to function—the relative position of the rear takedown hole 34M relative to the trigger well 20M, the fire/safe selector switch 22M, and the pistol grip attachment point 24M.

The buffer tube collar 36M will also be shifted rearwardly by distance D1, which would create a gap between its forward face 40M and the corresponding rear face of an upper receiver 30. To prevent this gap, and preserve compatibility with standard assault rifle upper receivers, an amount equal to D1 (e.g., an additional 0.3125 inch) is added to the forward face 40M of the collar 36M.

The above-described modifications result in a lower receiver 10M that can accommodate a longer magazine, and corresponding longer cartridges. To preserve compatibility with standard length cartridge magazines, the shape of the magazine well 12M rearward of the added length D1 is left unchanged, and the width of the magazine well 12M in the lengthened portion is made narrower. Inwardly extending, and forwardly-angled or perpendicular, shoulders 42M are formed in the magazine well 12M at the transition point from the standard length to the extended length to engage the forward side of a standard length magazine.

Figure 3:
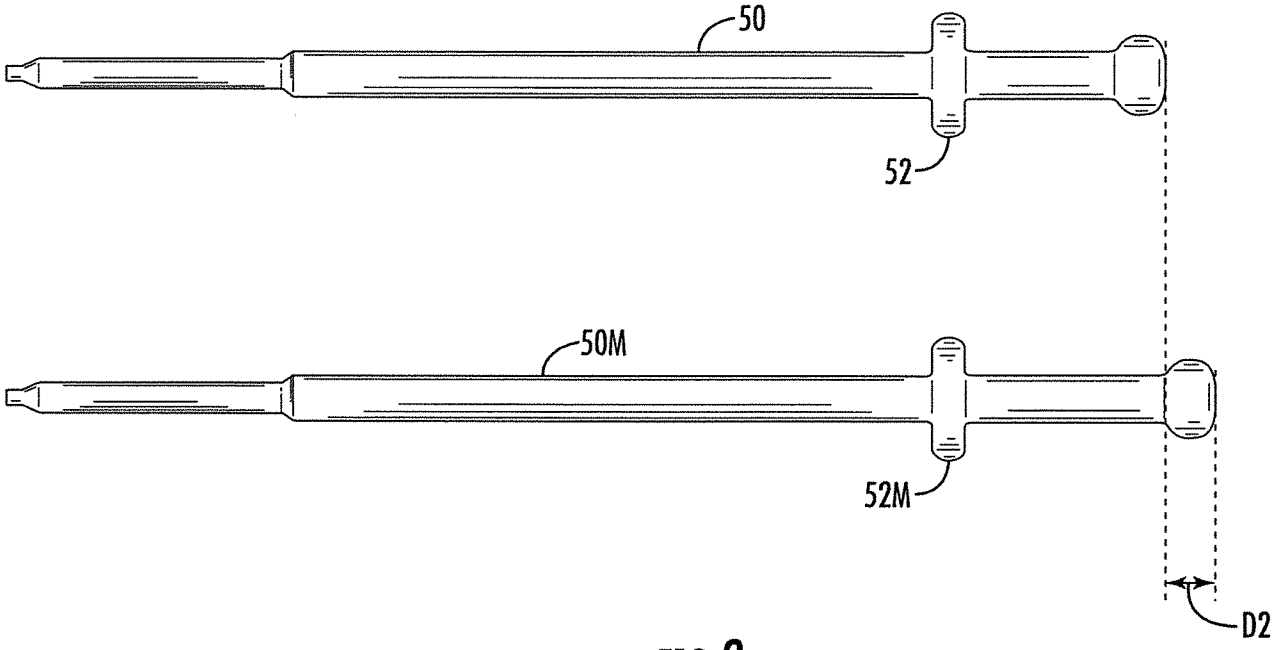
FIG. 3 is a side view of a modified firing pin for use in connection with the modified rifle lower receiver of FIG. 1 compared with a standard firing pin.

As discussed above, the trigger well 20M—and consequently the trigger mechanism and sear block, when installed—is shifted rearwardly by 0.3125 inch. To ensure proper engagement with the firing pin 50M, referring to FIGS. 3A and 3B, a standard firing pin 50 is modified by adding length D2 (most advantageously 0.25 inch) rearward of the firing pin retention collar 52M. Forward of the firing pin retention collar 52, 52M, the standard and modified firing pins 52, 52M preferably have the same dimensions. The present inventors have found that a firing pin thus modified will still readily fit into standard upper receivers without requiring any further modification thereto, while ensuring proper engagement with the rearwardly shifted sear block of the modified lower receiver. Notably, it is not necessary that D2=D1, and a value of D2<D1 (0.25 inch versus 0.3125 inch) has been found advantageous.

Figure 4:
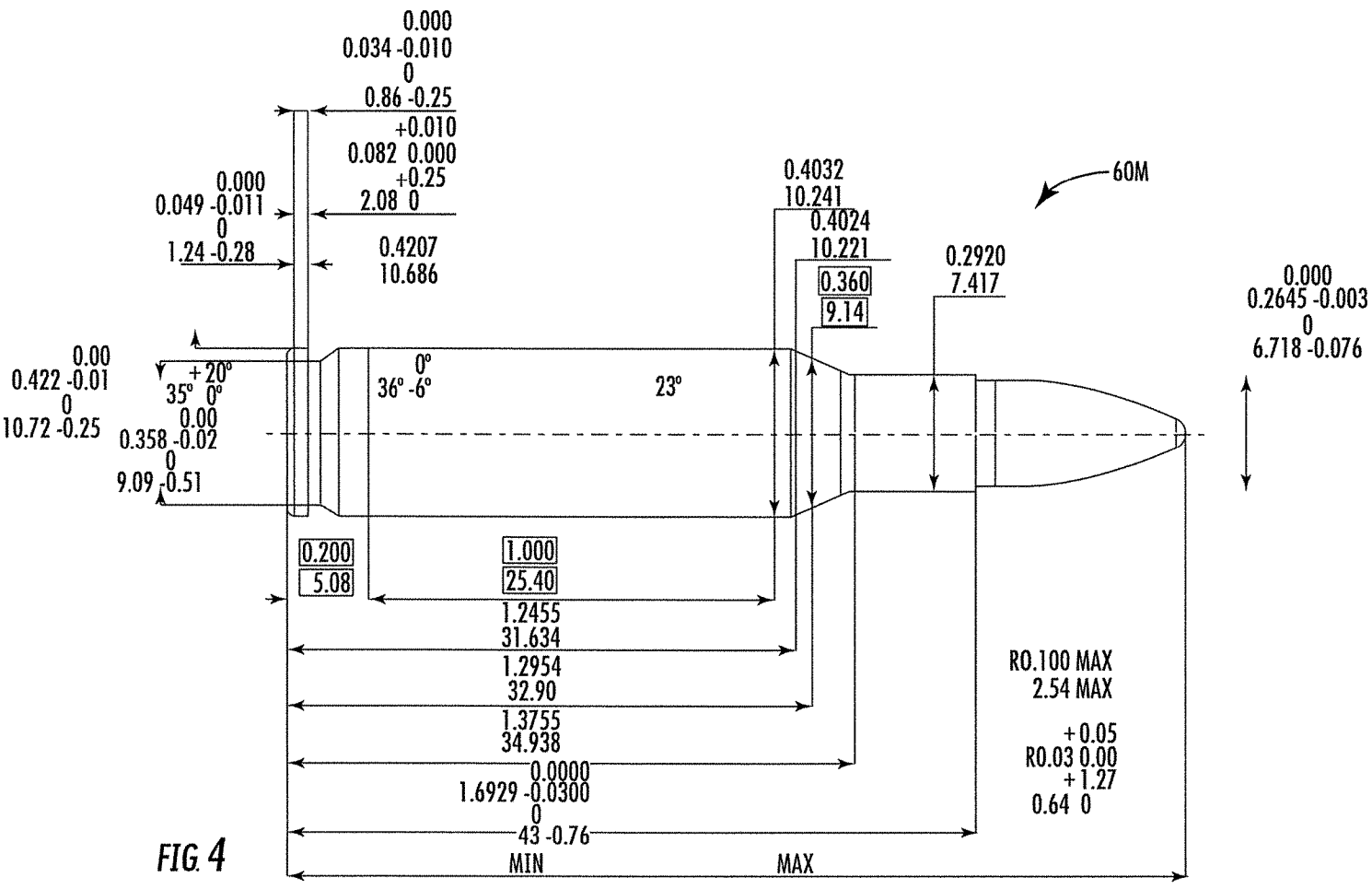
FIG. 4 is a plan view of a cartridge for use in connection with the modified rifle lower receiver of FIG. 1.

As previously noted, the modified lower receiver 10M for a standard assault rifle has a longer magazine well 12M and is accordingly able to accept magazines with longer cartridges. Dimensions for a cartridge 60M found to provide exceptional results (e.g., increased accuracy, range and velocity relative to cartridges previously available for standard assault rifles) are shown in FIG. 4 ([bracketed] dimensions are in millimeters, while unbracketed dimensions are inches). While this cartridge 60M is believed to represent a preferred embodiment, the modified lower receiver 10M is not necessarily limited to use therewith. Likewise, the cartridge 60M is potentially advantageous when employed in rifles not equipped with a modified lower receiver 10M.

The foregoing description is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A modified lower receiver for an AR-15 rifle, the modified lower receiver comprising:

a modified receiver body defining a modified magazine well, a trigger well and modified forward and rear takedown holes;

a magazine release mounted on a side of the modified receiver body and a extending into the modified magazine well and configured to releasably engage a magazine inserted therein;

wherein the modified magazine well is longer than a magazine well of an AR-15 lower receiver by a predetermined distance forward of the magazine release, positions of the modified forward and rear takedown holes also being, relative to a position of the magazine release, forward of respective positions of forward and rear takedown holes on the AR-15 lower receiver by the predetermined distance.

2. The modified lower receiver of claim 1, wherein the predetermined distance is 0.3125 inch.

3. The modified lower receiver of claim 1, wherein the modified receiver body further defines a modified buffer tube collar, a position of a modified forward face of the modified buffer tube collar being, relative to the position of the magazine release, forward of a respective position of a forward face of a buffer tube collar of the AR-15 lower receiver by the predetermined distance.

4. The modified lower receiver of claim 1, wherein a position of the trigger well, relative to the position of the magazine well, is unchanged from a position of a trigger well of the AR-15 lower receiver.

5. The modified lower receiver of claim 1, further comprising a fire/safe selector switch mounted on the side of the modified lower receiver, wherein a position of the fire/safe selector switch, relative to the position of the magazine well, is unchanged from a position of a fire/safe selector switch of the AR-15 lower receiver.

6. The modified lower receiver of claim 1, wherein a first width of the modified magazine well rearwardly of the predetermined distance from a front wall thereof is unchanged from a respective width of the magazine well of the AR-15 lower receiver.

7. The modified lower receiver of claim 6, wherein a second width of the modified magazine well forwardly of the predetermined distance from the front wall thereof is narrower than the first width.

8. The modified lower receiver of claim 7, wherein inwardly extending shoulders are formed in the modified magazine well at a transition between the first width and the second width, the inwardly extending shoulders and the first width allowing accommodation of a standard length magazine within the modified magazine well.

9. A rifle comprising:

the modified lower receiver of claim 1;

an AR-15 upper receiver connected thereto via the forward and rear takedown holes; and a modified firing pin slidably retained in the AR-15 upper receiver, the modified firing pin being lengthened relative to a standard firing pin.

10. The firearm of claim 9, wherein the firing pin is lengthened by a different predetermined distance than the predetermined distance.

11. The firearm of claim 10, wherein the different predetermined distance is 0.25 inch.

12. The firearm of claim 9, wherein the modified firing pin is lengthened relative to the standard firing pin rearwardly of a firing pin retention collar.

* * * * *